US012727685B2

(12) United States Patent
Parker

(10) Patent No.: US 12,727,685 B2
(45) Date of Patent: Sep. 8, 2026

(54) BOOSTER SEATS STORAGE AND ORGANIZER DEVICE

(71) Applicant: Hugh Parker, Crestview, FL (US)

(72) Inventor: Hugh Parker, Crestview, FL (US)

( * ) Notice: Subject to any disclaimer, the term of this patent is extended or adjusted under 35 U.S.C. 154(b) by 0 days.

(21) Appl. No.: 18/917,182

(22) Filed: Oct. 16, 2024

(65) Prior Publication Data

US 2025/0143487 A1 May 8, 2025

Related U.S. Application Data

(60) Provisional application No. 63/595,497, filed on Nov. 2, 2023.

(51) Int. Cl.
*A47F 7/00* (2006.01)
*A47F 7/30* (2006.01)

(52) U.S. Cl.
CPC ..... *A47F 7/0007* (2013.01); *A47F 7/30* (2013.01)

(58) Field of Classification Search
CPC .. A47F 5/00; A47F 5/112; A47F 5/116; A47F 5/08; A47F 5/10; A47F 7/00; A47F 7/0007; A47F 7/30; A47B 81/00
See application file for complete search history.

(56) References Cited

U.S. PATENT DOCUMENTS 2,324,232 A * 7/1943 Pantalone ..... A47F 5/112 211/73
3,285,399 A * 11/1966 Snow ..... A47F 5/112 229/164
4,322,005 A * 3/1982 Robertson ..... A47F 5/116 108/2
D269,752 S * 7/1983 Bolyn ..... D6/657
4,646,922 A * 3/1987 Smith ..... A47F 5/116 211/186
4,723,664 A * 2/1988 Smith ..... A47F 5/112 211/132.1
4,760,928 A * 8/1988 Bustos ..... A47F 5/118 211/59.4

(Continued)

FOREIGN PATENT DOCUMENTS

DE 102024108095 B3 * 4/2025 ..... A47F 5/114
FR 2783237 A1 * 3/2000 ..... A47F 5/112

(Continued)

*Primary Examiner* — Patrick D Hawn
(74) *Attorney, Agent, or Firm* — Brennan, Manna & Diamond, LLC

(57) ABSTRACT

A booster seat organizer stand adapted to accommodate a plurality of children's booster seats in a stacked vertical orientation is disclosed. The stand features a flat base with raised walls forming a cavity to securely hold the booster seats. A vertical back panel extends from the rear edge of the base to provide additional support and a pair of side panels extend from side edges of the back panel and has wavy contours to offer lateral stability to the stacked booster seats. The stand can include one or more storage compartments for accessories, a detachable hook for wall mounting, and an additional storage compartment integrated or detachably attached to the base. The stand can be used in homes, daycares, restaurants, and public facilities and enhances safety, convenience, and organization for storing children's booster seats.

10 Claims, 5 Drawing Sheets

(56) References Cited

U.S. PATENT DOCUMENTS 5,259,578 A * 11/1993 Jones ..... A47C 5/005 297/440.13
5,423,508 A * 6/1995 Isenga ..... B60N 3/108 224/407
5,497,891 A * 3/1996 Hannon ..... A47F 7/0021 248/152
5,662,382 A 9/1997 Kerr
5,711,438 A * 1/1998 Smith ..... B62B 5/0083 280/47.24
D461,646 S 8/2002 Kain
6,848,586 B1 2/2005 Guliner
6,915,947 B2 * 7/2005 Siurek ..... B65D 5/0005 229/101
6,920,985 B2 * 7/2005 Chandaria ..... A47F 7/00 211/13.1
6,966,447 B2 * 11/2005 Hiltke ..... A47F 5/116 211/72
7,278,683 B2 10/2007 Williams
7,293,792 B2 11/2007 Wilson
7,370,912 B2 5/2008 Williams
7,571,820 B2 * 8/2009 Alexander ..... A47F 5/10 211/73
10,202,786 B1 * 2/2019 Keegan ..... A47L 5/36
D854,359 S * 7/2019 Chambers ..... D6/662
10,765,202 B2 * 9/2020 Krystalovich ..... A47B 61/06
10,799,042 B2 * 10/2020 Smithson ..... H05K 1/118
10,842,297 B2 * 11/2020 Meuti ..... A47F 5/116
11,832,741 B2 * 12/2023 Burgert ..... A47F 5/116
2005/0274684 A1 * 12/2005 Swanson ..... A47B 49/00 211/78
2007/0187346 A1 * 8/2007 Markson ..... A47F 5/0025 211/71.01
2023/0397721 A1 * 12/2023 Doane ..... A47F 5/114
2024/0000227 A1 * 1/2024 Hautala ..... H04R 1/028

FOREIGN PATENT DOCUMENTS

FR 2809606 A1 * 12/2001 ..... A47F 5/0815
WO WO-2018148953 A1 * 8/2018 ..... A47F 7/00

* cited by examiner

BOOSTER SEATS STORAGE AND ORGANIZER DEVICE

CROSS-REFERENCE TO RELATED APPLICATION

The present application claims priority to, and the benefit of, U.S. Provisional Application No. 63/595,497, which was filed on Nov. 2, 2023, and is incorporated herein by reference in its entirety.

FIELD OF THE INVENTION

The present invention generally relates to the field of storage devices for chairs. More specifically, the present invention relates to a novel storage device for storing a plurality of booster seats. The device is adapted to store and organize the seats in a vertical or upright stack, keeping the seats easily accessible. The device can be customized and can also be wall-mounted or free-standing floor unit. The device offers a simple and convenient method of keeping all booster seats in a single, easily accessible location. Accordingly, the present disclosure makes specific reference thereto. Nonetheless, it is to be appreciated that aspects of the present invention are also equally applicable to other like applications, devices, and methods of manufacture.

BACKGROUND

By way of background, booster seats are essential safety devices used by caregivers and parents for proper positioning of seat belts for children who have outgrown their forward-facing car seats but are still too small to fit adult seat belts properly. Booster seats safeguard children during car rides by elevating them to a height where the vehicle's seat belt fits correctly across their shoulder and lap, thereby reducing the risk of injury in the event of an accident. However, booster seats are not only used in vehicles; they are commonly found in various settings such as homes, schools, restaurants, and daycare centers. A significant challenge arises concerning the storage and organization of the booster seats.

Commonly, there is no dedicated storage space for booster seats and therefore, booster seats are often left strewn about, contributing to a cluttered and disorganized space. Caregivers and parents find it hard to quickly locate and access the seats when needed. When booster seats are left on the floor, they can become tripping hazards, posing a risk of injury to children and adults alike. Also, without a designated storage area, booster seats can easily be misplaced or lost, leading to frustration and inconvenience for caregivers. Booster seats that are not stored properly are more prone to damage and can be exposed to physical wear, spills, and other damaging factors. In light of these challenges, there is a need for an effective storage solution that addresses the disorganization, safety hazards, and potential damage associated with improperly stored booster seats.

Therefore, there exists a long felt need in the art for a storage device for storing booster seats. There is also a long felt need in the art for a novel storage device that provides a practical, efficient, and safe method for storing multiple booster seats in a variety of settings. Additionally, there is a long felt need in the art for a dedicated storage solution that protects the booster seats from damage, thereby extending their usability and maintaining their effectiveness in safeguarding children. Moreover, there is a long felt need in the art for a unique mounting storage device that enables users to stack the booster seats vertically for easy and convenient storage and accessibility. Further, there is a long felt need in the art for a booster seats storage device that addresses the disorganization, safety hazards, and potential damage associated with improperly stored booster seats. Furthermore, there is a long felt need in the art for booster seats storage device that can be available as a free-standing floor unit or a wall mounted unit. Finally, there is a long felt need in the art for a uniquely designed storage device that offers a simple and convenient method of storing booster seats in a single, easily accessible location.

The subject matter disclosed and claimed herein, in one embodiment thereof, comprises booster seats storage and organizer stand. The stand features a generally square or rectangular base having a flat surface and raised walls, the raised walls extend vertically from the front edge and side edges of the base, forming a cavity sized to accommodate a plurality of children's booster seats stacked vertically, a vertical back panel extends vertically upward from the rear edge of the base, providing support to the booster seats stored in the cavity, a first side panel extends transversely from a first side edge of the back panel and a second side panel extends transversely from a second side edge of the back panel, the side panels provide lateral support to the booster seats, wherein the side panels include decorative wavy contoured trailing edges. A decal or nameplate is disposed (i.e., mounted) on the stand for customization and personalization.

In this manner, the booster seats organizer device of the present invention accomplishes all of the forgoing objectives and provides users with a novel device for storing booster seats. The device enables vertical or upright stacking of multiple booster seats and is beneficial in settings with limited storage areas, such as homes, schools, and daycare centers. The stand helps maintain an organized environment and the booster seats are stacked and are easily accessible. The stand minimizes safety hazards by keeping booster seats off the floor, thereby eliminating tripping risks. The secure stacking mechanism ensures that the seats remain stable and do not pose any danger to children or adults moving around the area. In use, users can pull the top seat off the stack without disturbing the others, thereby streamlining the process of accessing and storing the seats. The stand can be personalized with interchangeable decals or nameplates, enabling users to customize it according to their preferences.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a booster seat organizer stand. The stand is portable, lightweight, and durable and comprises a base having a flat surface and raised walls, the raised walls extend vertically from the front edge and side edges of the base, forming a cavity sized to accommodate a plurality of children's booster seats stacked vertically, a vertical back panel extends vertically upward from the rear edge of the base, providing support to the booster seats stored in the cavity, a first side panel extends transversely from a first side edge of the back panel and a second side panel extends transversely from a second side edge of the back panel, the side panels provide lateral support to the booster seats, wherein the side panels include decorative wavy contoured trailing edges.

In yet another embodiment, a booster seat organizer stand for storing a plurality of booster seats is disclosed. The stand includes a base having a flat surface and raised walls extending vertically from the front edge and side edges of the base, forming a cavity sized to accommodate a plurality of children's booster seats stacked vertically, a vertical back panel extends vertically upward from the rear edge of the base, providing support to the booster seats stored in the cavity, one or more storage compartments disposed (i.e., mounted) on an outer surface of at least one of side panels for storing accessories, wherein the side panels extend transversely from the side edges of the back panel, and a detachable hook is mounted on the rear surface of the back panel for securing the organizer stand to a wall.

In another embodiment, a portable organizer stand for booster seats is disclosed. The stand includes a base having a flat surface and raised walls extending vertically from the front edge and side edges of the base, forming a cavity sized to accommodate a plurality of children's booster seats stacked vertically, a vertical back panel extending vertically upward from the rear edge of the base, providing support to the booster seats stored in the cavity, and an additional storage compartment integrated or detachably attached to the bottom surface of the base for storing additional items.

In another aspect, a customizable decal or nameplate is disposed (i.e., mounted) on the front surface of the back panel for personalization, wherein the customizable decal or nameplate is interchangeable, enabling users to personalize the stand with different designs or labels.

In yet another aspect, the raised walls have a height in the range of about 3 inches to about 6 inches.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
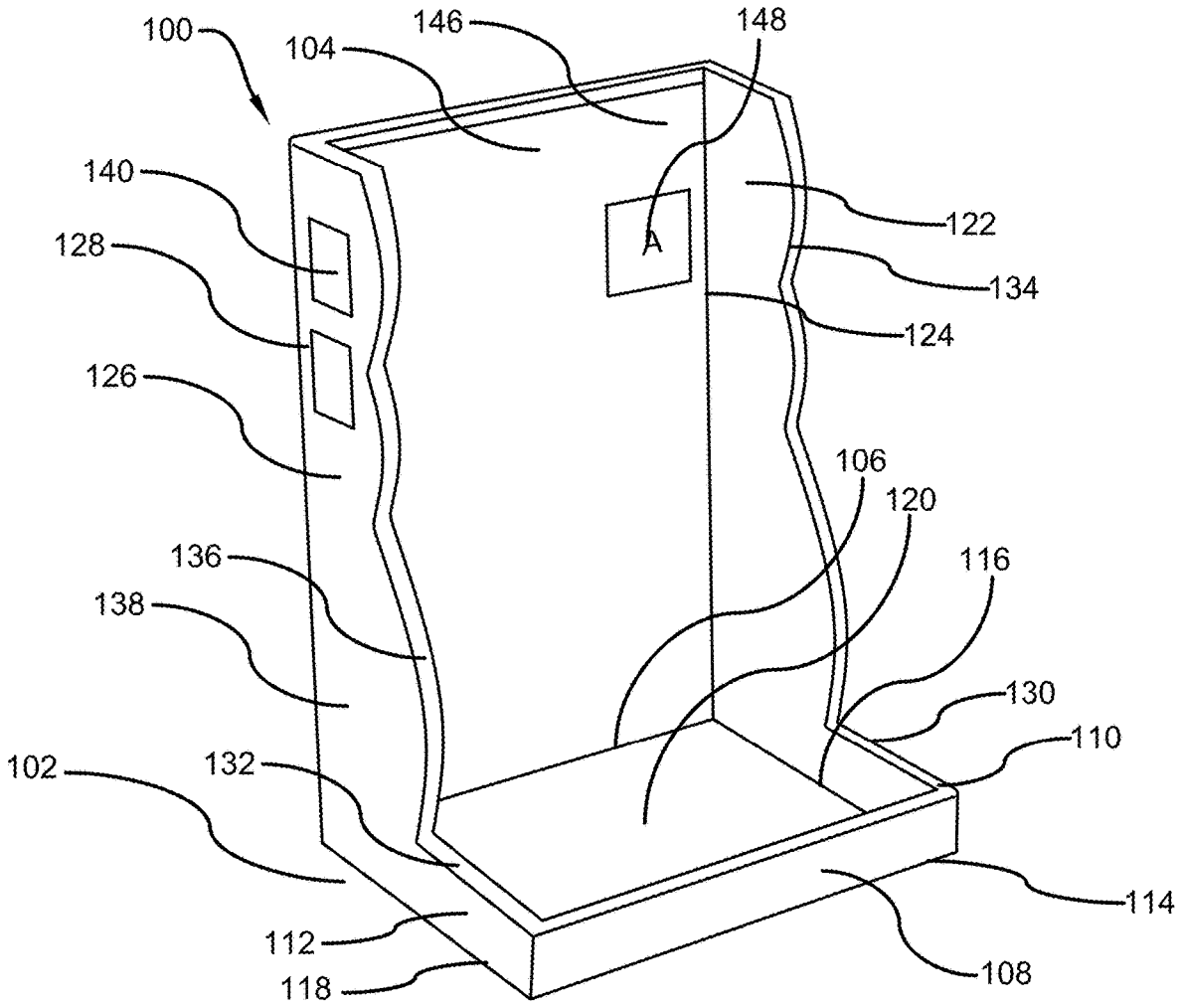
FIG. 1 illustrates a perspective view of booster seat organizer stand of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a storage device for storing booster seats. There is also a long felt need in the art for a novel storage device that provides a practical, efficient, and safe method for storing multiple booster seats in a variety of settings. Additionally, there is a long felt need in the art for a dedicated storage solution that protects the booster seats from damage, thereby extending their usability and maintaining their effectiveness in safeguarding children. Moreover, there is a long felt need in the art for a unique mounting storage device that enables users to stack the booster seats vertically for easy and convenient storage and accessibility. Further, there is a long felt need in the art for a booster seat(s) storage device that addresses the disorganization, safety hazards, and potential damage associated with improperly stored booster seats. Furthermore, there is a long felt need in the art for booster seats storage device that can be available as a free-standing floor unit or a wall mounted unit. Finally, there is a long felt need in the art for a uniquely designed storage device that offers a simple and convenient method of storing booster seats in a single, easily accessible location.

The present invention, in one exemplary embodiment, is a portable organizer stand for booster seats. The stand includes a base having a flat surface and raised walls extending vertically from the front edge and side edges of the base, forming a cavity sized to accommodate a plurality of children's booster seats stacked vertically, a vertical back panel extending vertically upward from the rear edge of the base, providing support to the booster seats stored in the cavity, and an additional storage compartment integrated or detachably attached to the bottom surface of the base for storing additional items.

Reference will now be made in detail to the present preferred embodiments of the invention, examples of which are illustrated in the accompanying drawings. Wherever possible, the same reference numerals are used in the drawings and the description to refer to the same or like parts.

Referring initially to the drawings, FIG. 1 illustrates a perspective view of booster seat organizer stand of the present invention in accordance with the disclosed structure. The booster seat organizer stand 100 of the present invention is designed to store a plurality of children's booster seats efficiently and safely. The booster seat organizer stand 100 enables the booster seats to be stored in a stacked form wherein one seat is stacked on top of another seat. More specifically, the stand device 100 is portable, lightweight, and durable and includes a base 102. The base 102 is preferably flat or horizontal and generally rectilinear but can be of any geometric shape to be compatible with booster seats of different shapes and sizes. A vertical back panel 104 extends vertically upward from the rear edge 106 of the base 102. The vertical back panel 104 is preferably planar and provides support to the booster chair accommodated and stored in the stand device 100.

The base 102 has raised walls 108, 110, 112 extending vertically upward from the front edge 114 and side edges 116, 118, respectively. The base 102 along with the raised walls 108, 110, 112 and back panel 104 form a cavity 120 sized to fit standard children booster seats. The raised walls 108, 110, 112 preferably have same height and can be in the range from about 3 inches to about 6 inches. The raised walls 108, 110, 112 help prevent the accommodated booster chairs/seats from lateral movement on the base 102.

A first side panel 122 extends transversely from the first side edge 124 of the back panel 104 and a symmetrical second side panel 126 extends transversely from the second side edge 128 of the back panel 104. The side panels 122, 126 are preferably parallel and extend to the top edges 130, 132 of the raised walls 110, 112, respectively. The first side panel 122 has a wavy contoured trailing edge 134 and adds a decorative element as well to the booster seat organizer stand 100. Similarly, the second side panel 126 has symmetrical wavy contoured trailing edge 136. The side panels 122, 126 provide lateral support to the booster chairs/seats/seats stored in the stand device 100. The side panels 122, 126 extend transversely from about 4 inches to about 8 inches from the back panel 104.

Figure 2:
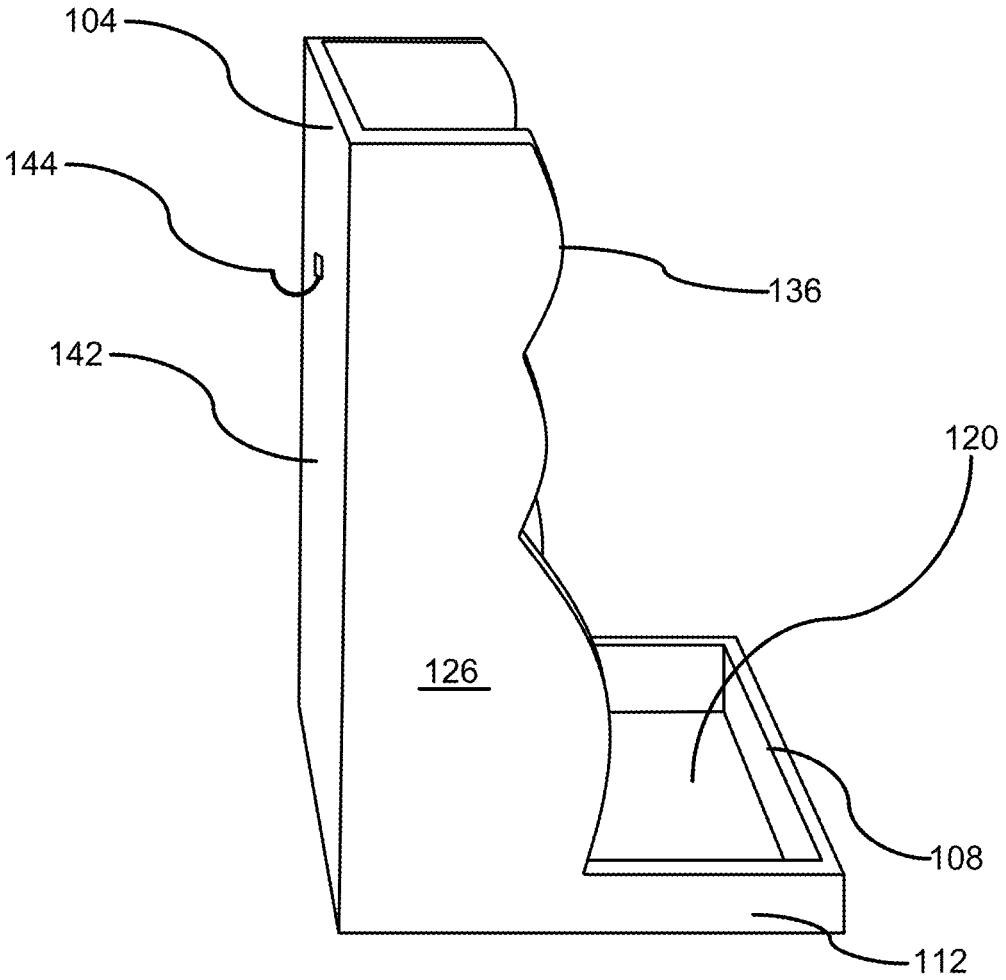
FIG. 2 illustrates a rear perspective view of the booster seat organizer stand of the present invention in accordance with the disclosed structure.

The outer surface 138 of one or both of the side panels 122, 126 may include one or more storage compartments 140 for storing accessories like seat covers, manuals, or cleaning supplies. Referring to FIG. 2, the rear surface 142 of the back panel 104 includes a hook 144 for mounting the stand device 100 to a wall. The hook 144 can be detached from the back panel 104 as per preferences of a user. The front surface 146 of the back panel 104 can have an interchangeable decal or nameplate 148 disposed (i.e., mounted) thereon for customization and personalization of the stand device 100.

The stand 100 has a one-piece construction and is preferably made from durable materials such as heavy-duty plastic, metal, or a combination of both to provide longevity and support the weight of a plurality of booster seats. The booster seats organizer stand 100 can be used in homes, particularly in households with multiple children and in public places like daycares, schools, restaurants, or any facility that requires organized storage of multiple booster seats.

FIG. 2 illustrates a rear perspective view of the booster seat organizer stand of the present invention in accordance with the disclosed structure. As illustrated, the rear surface 142 includes the hook 144 which is a universal mounting system that enables the stand unit 100 to be easily attached to various wall types (drywall, concrete, etc.) without additional tools. The hook 144 can be removed to convert the stand unit 100 into a free-standing unit when needed.

Figure 3:
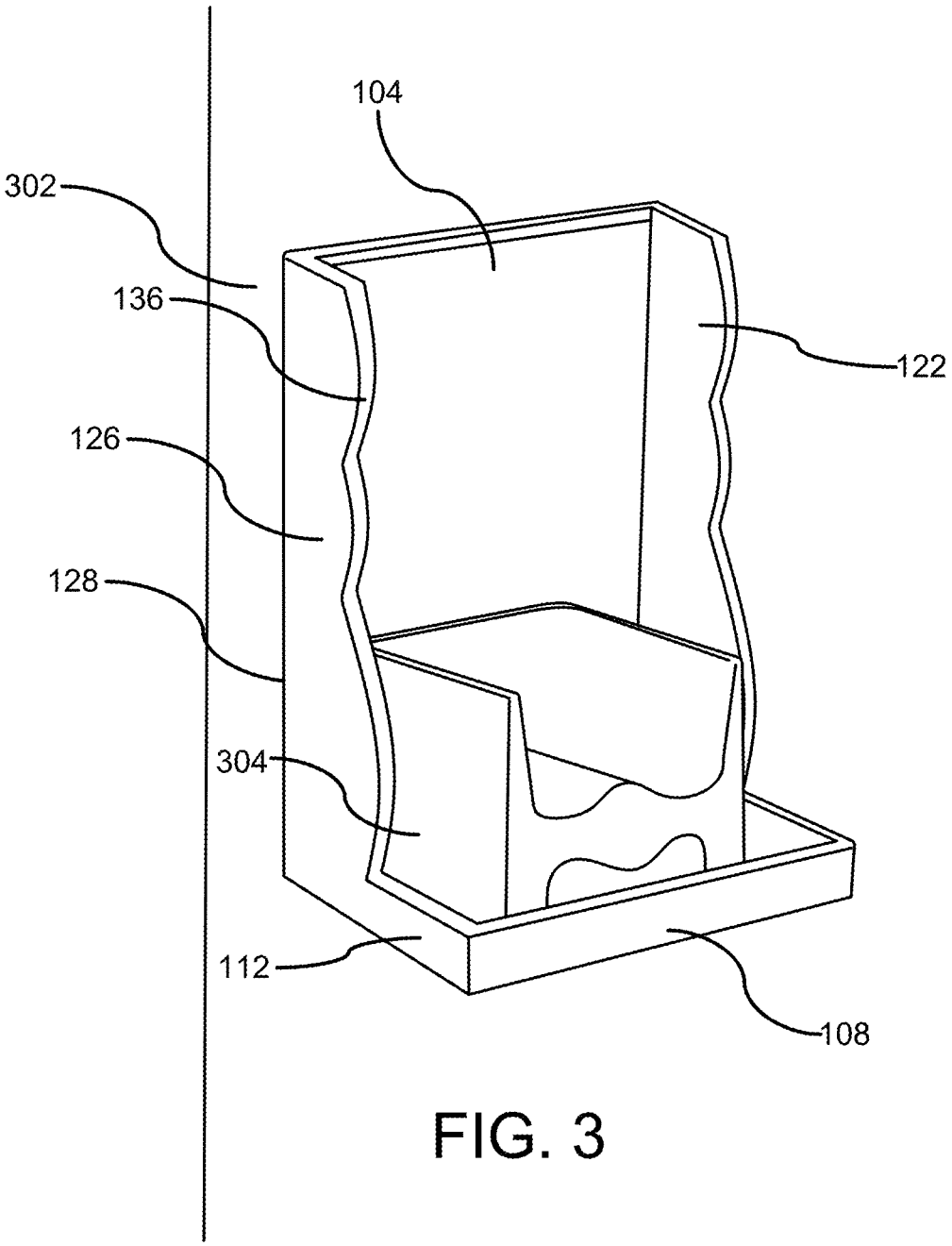
FIG. 3 illustrates a perspective view showing the booster seat organizer stand of FIG. 1 mounted to a wall and storing booster chairs/seats in accordance with the disclosed structure.

FIG. 3 illustrates a perspective view showing the booster seat organizer stand of FIG. 1 mounted to a wall and storing booster chairs/seats in accordance with the disclosed structure. As illustrated, the stand device 100 is mounted to a wall 302 such that the back panel 104 adheres to the wall 302 and the cavity can be easily accessed to store a plurality of booster chairs/seats 304 in the form of a stack.

Figure 4:
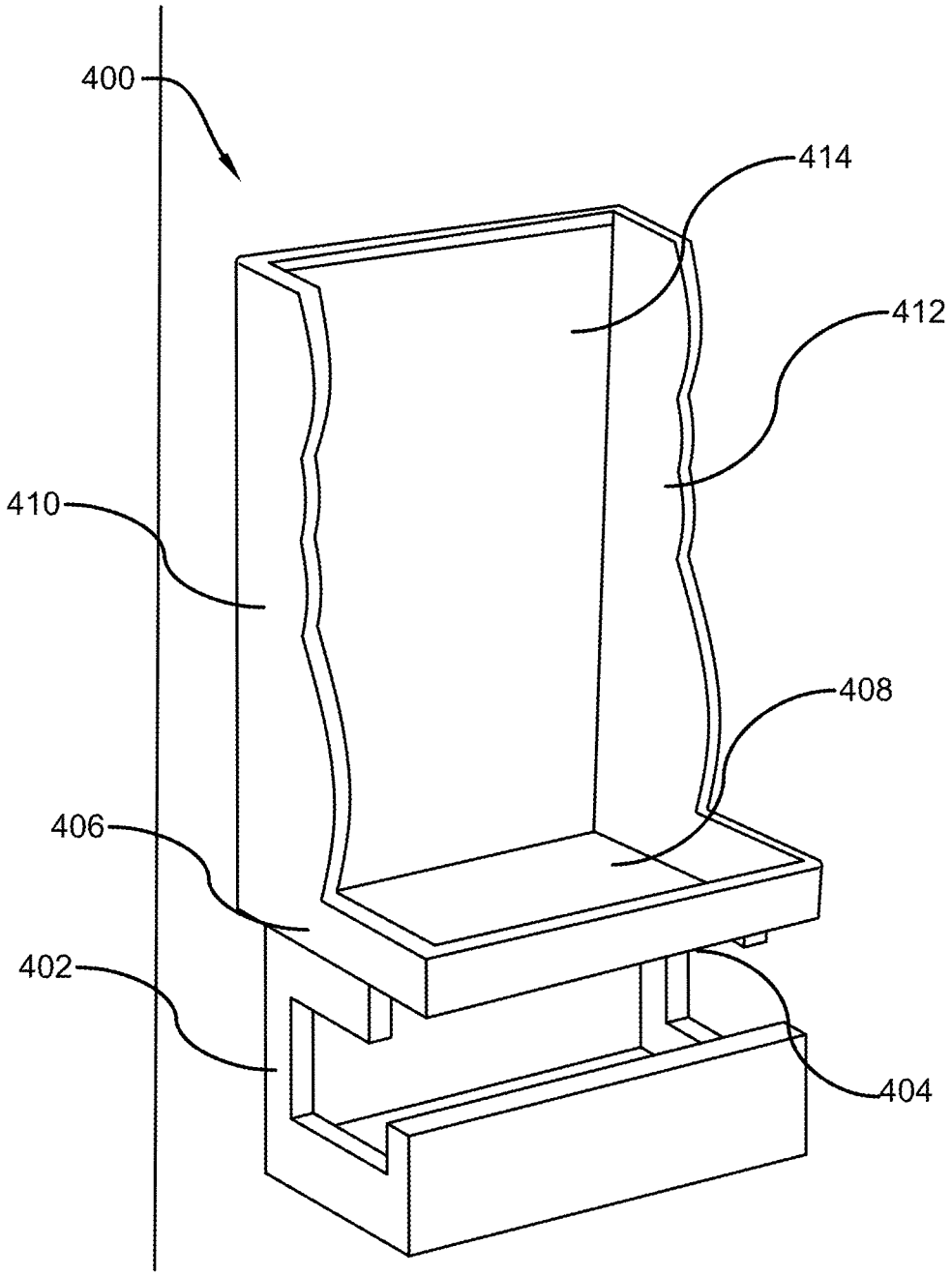
FIG. 4 illustrates a perspective view of another embodiment of the booster seat organizer stand of the present invention in accordance with the disclosed structure.

FIG. 4 illustrates a perspective view of another embodiment of the booster seat organizer stand of the present invention in accordance with the disclosed structure. In the present embodiment, the stand 400 includes an additional storage compartment 402 disposed (i.e., mounted) on the bottom surface 404 of the base 406. The additional storage compartment 402 can be integrated or can be slidably and detachably attached to the base 406. The additional storage compartment 402 having a front raised edge can be used for hanging or storing bags or any other items of the children. The cavity 408 is used for storing the booster seats and the seats are supported by side panels 410, 412, back panel 414 and raised walls of the base 406. The booster seat organizer stand 100, 400 of the present invention can be customized and can have any printed or designed surface for customization and personalization as per preferences of users.

Figure 5:
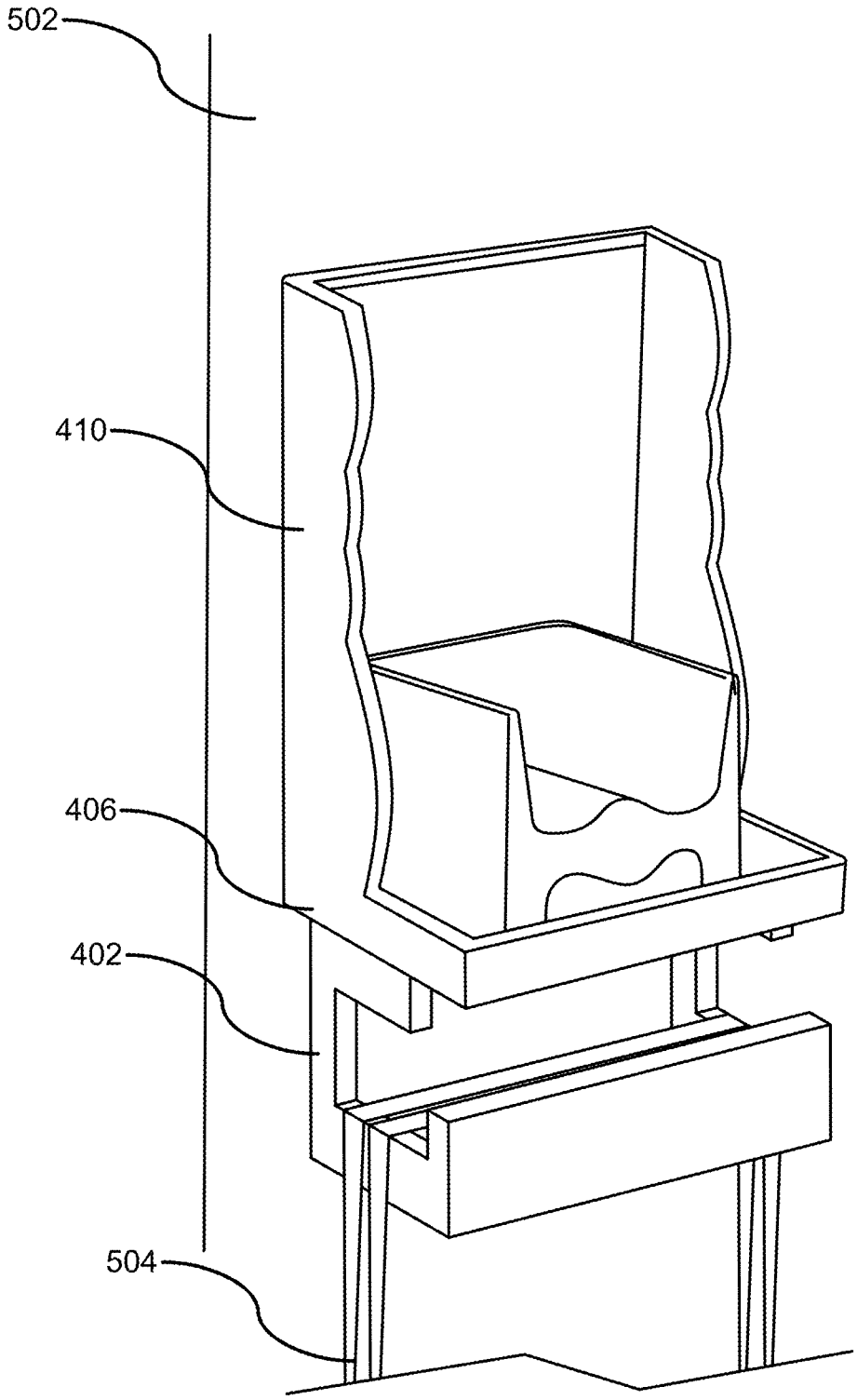
FIG. 5 illustrates a perspective view showing the booster seat organizer stand of FIG. 4 mounted to a wall in accordance with the disclosed structure.

FIG. 5 illustrates a perspective view showing the booster seat organizer stand of FIG. 4 mounted to a wall in accordance with the disclosed structure. As illustrated, the stand 400 is mounted to a wall 502 using the wall mounted hook as described earlier in the disclosure. The additional storage compartment 402 is easily accessible and can be independently used for storing and hanging different personal items 504, bags, and more for children. The booster seats are stored on stand and can be easily accessed from the open cavity. The free-standing version of the stand can have a plurality of casters at the bottom of the base 102 and the casters can be 360-degrees rotatable for easy movement along a surface.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "portable booster seat storage system", "booster seat organizer stand", "booster seat storage and organizer stand", "stand", and "stand device" are interchangeable and refer to the portable booster seat storage system 100, 400 of the present invention.

Notwithstanding the forgoing, the portable booster seat storage system 100, 400 of the present invention can be of any suitable size and configuration as is known in the art without affecting the overall concept of the invention, provided that it accomplishes the above stated objectives. One of ordinary skill in the art will appreciate that the portable booster seat storage system 100, 400 as shown in the FIGS. are for illustrative purposes only, and that many other sizes and shapes of the portable booster seat storage system 100, 400 are well within the scope of the present disclosure. Although the dimensions of the portable booster seat storage system 100, 400 are important design parameters for user convenience, the portable booster seat storage system 100, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A booster seat organizer stand comprising:

a base having a front raised wall, a first raised side wall, and a second raised side wall;

a back panel;

a hook removably attachable to a rear surface of the back panel;

a first side panel; and a second side panel;

wherein said base is horizontal and rectilinear;

wherein said back panel extends vertically upward from a rear edge of said base;

wherein said back panel is planar for providing support to a plurality of booster seats stored in a booster seat organizer stand;

wherein said front raised wall, said first raised side wall, said second raised side wall, and said back panel forming a cavity for supporting said plurality of booster seats stored in said booster seat organizer stand;

wherein said front raised wall, said first raised side wall, and said second raised side wall having the same height;

wherein said first side panel extending transversely from a first side edge of said back panel;

wherein said second side panel extending transversely from a second side edge of said back panel;

wherein said first side panel is parallel to said second side panel;

wherein said front raised wall, said first raised side wall, and said second raised side wall having a height from 3 inches to 6 inches for retaining said plurality of booster seats from lateral movement; and further wherein the first side panel comprises a storage compartment.

2. The booster seat organizer stand of claim 1, wherein said first side panel extending from a top edge of said back panel to a top edge of said first raised side wall.

3. The booster seat organizer stand of claim 2, wherein said second side panel extending from a top edge of said back panel to a top edge of said second raised side wall.

4. The booster seat organizer stand of claim 3, wherein said first side panel and said second side panel extending from 4 inches to 8 inches from said back panel for providing lateral retention to said plurality of booster seats.

5. The booster seat organizer stand of claim 1, wherein said booster seat organizer stand retains said plurality of booster seats in a stacked arrangement.

6. The booster seat organizer stand of claim 5, wherein said booster seat organizer stand having a one-piece construction from a material selected from the group consisting of a plastic and a metal.

7. A booster seat organizer stand comprising:

a base having a front raised wall, a first raised side wall, and a second raised side wall;

a back panel;

a hook removably attachable to a rear surface of the back panel;

a first side panel;

a second side panel; and a plurality of casters;

wherein said base is horizontal and rectilinear;

wherein said back panel extends vertically upward from a rear edge of said base;

wherein said back panel is planar for providing support to a plurality of booster seats stored in a booster seat organizer stand;

wherein said front raised wall, said first raised side wall, said second raised side wall, and said back panel forming a cavity for supporting said plurality of booster seats stored in said booster seat organizer stand;

wherein said front raised wall, said first raised side wall, and said second raised side wall having the same height;

wherein said first side panel extending transversely from a first side edge of said back panel;

wherein said second side panel extending transversely from a second side edge of said back panel;

wherein said first side panel is parallel to said second side panel;

wherein said front raised wall, said first raised side wall, and said second raised side wall having a height from 3 inches to 6 inches for retaining said plurality of booster seats from lateral movement;

wherein said plurality of casters mounted on a bottom surface of said base; and wherein said plurality of casters having 360-degree rotation for rolling said booster seat organizer stand;

wherein the first side and second panel each comprise a storage compartment; and further wherein the first side and second panel each further comprise a symmetrical wavy contoured trailing edge.

8. The booster seat organizer stand of claim 7, wherein said first side panel extending from a top edge of said back panel to a top edge of said first raised side wall.

9. The booster seat organizer stand of claim 8, wherein said second side panel extending from a top edge of said back panel to a top edge of said second raised side wall.

10. The booster seat organizer stand of claim 9, wherein said first side panel and said second side panel extending from 4 inches to 8 inches from said back panel for providing lateral retention to said plurality of booster seats, and further wherein said booster seat organizer stand retains said plurality of booster seats in a stacked arrangement.

* * * * *